US005893678A

United States Patent [19]

Laybros et al.

[11] Patent Number: 5,893,678

[45] Date of Patent: Apr. 13, 1999

[54] DEVICE FOR COMMANDING A SUPPLY CIRCUIT ESPECIALLY APPLICABLE TO A ROAD MARKING MACHINE

[75] Inventors: Pascal Laybros, Aurillac; Jean-Francois Scherer, Creutzwald, both of France

[73] Assignee: Euroliners, Boulay, France

[21] Appl. No.: 08/845,144

[22] Filed: Apr. 21, 1997

[30] Foreign Application Priority Data

Apr. 19, 1996 [FR] France ..... 96 04958

[51] Int. Cl.[6] ..... E01C 23/16

[52] U.S. Cl. ..... 404/94; 239/150

[58] Field of Search ..... 404/93, 94; 239/150

[56] References Cited

U.S. PATENT DOCUMENTS 3,571,664 3/1971 John et al. ..... 317/140
5,263,789 11/1993 Torntore et al. ..... 404/93

FOREIGN PATENT DOCUMENTS 0 594 519 4/1994 European Pat. Off. .
1 119 316 12/1961 Germany .
1 223 135 2/1971 United Kingdom .

*Primary Examiner*—James Lisehora
*Attorney, Agent, or Firm*—Young & Thompson

[57] ABSTRACT

A command device for a paint supply circuit in a road marking machine (1) includes at least one paint spray gun (2) mounted on a support chassis (11) that can be moved on a roadway (10) along a line to be marked and linked to a paint supply circuit (3) provided with a triggering unit (21) for the application of the paint. The machine is equipped with a device that alternately commands the opening and the closing of the supply circuit, comprising a mobile lever (5) pivotably mounted on the chassis (1) and carrying apparatus (52) for actuating the triggering unit (21), the pivoting of the lever (5) being commanded by a flexible link that winds onto a pulley (61) liable of being driven in rotation by a motor (62) alternately in a direction for winding on the flexible link (63) determining pivoting of the lever (5) for the opening of the circuit (3) and in the direction for unwinding it to close the circuit (3), the pulley (61) being associated with apparatus (73) for removably locking it, at least in the position of opening the circuit (3), allowing the triggering unit (21) to be held in the open position without any action of the motor.

9 Claims, 2 Drawing Sheets

DEVICE FOR COMMANDING A SUPPLY CIRCUIT ESPECIALLY APPLICABLE TO A ROAD MARKING MACHINE

FIELD OF THE INVENTION

This invention relates to a device for commanding a supply circuit that is especially applicable to a road marking machine for the application of a paint.

BACKGROUND OF THE INVENTION

In order to create marking lines on a roadway, marking machines are normally used that comprise one or several spray guns connected to a paint supply system, the assembly being mounted on a support chassis that moves on the roadway and is directed by an operator so that a line to be marked is followed.

Generally, the paint supply system comprises a paint reservoir and a pressurising unit (pump or compressor) connected with one or several spray guns by a supply circuit fitted with a triggering unit that allows the circuit to be opened and closed for spraying the paint and for stopping the spraying.

Usually the triggering of the opening and closing of the spray guns is commanded by an electronic unit, for example a programmable controller type unit.

In certain machines, spraying is carried out by means of compressed air supplied by a compressor and in this case, the triggering of the phases of opening and closing of the spray guns can be carried out by means of electronically controlled valves connected as a by-pass to the compressed air system.

Other types of machines are linked to a source of electrical energy which can be the mains, on an urban site, or relatively large batteries. The guns can then be actuated by an electromagnet.

Such solutions are only worthwhile for large and rather expensive marking machines. In certain cases, however it would be useful to have more lightweight marking machines, for example, for the maintenance of driveways by the users and it is desirable to avoid the use of an air compressor or large batteries in order to reduce the size and the cost of the machine.

SUMMARY OF THE INVENTION

The aim of the invention is to overcome such a problem with a command device for spray guns having a very low electrical power consumption and which is consequently liable of being powered by small rechargeable batteries.

Therefore, the invention is applicable in a general way to a road marking machine comprising at least one paint application gun mounted on a support chassis that can be moved on a roadway along a line to be marked and connected to a paint supply circuit provided with a triggering unit linked to a device that alternately commands the opening and the closing of the supply circuit.

In accordance with the invention, the command device comprises a means of commanding alternately the opening and the closing of the supply circuit comprising a mobile lever pivotably mounted around a spindle on the chassis and carrying a means of actuating the triggering unit by pivoting said lever around its spindle, respectively in an opening direction and in a direction for closing the circuit, the pivoting of the lever being commanded by a flexible link winding onto a pulley mounted so that it rotates around a spindle on the chassis and liable of being driven in rotation by a motor, alternately in a direction for winding on the flexible link that determines the pivoting of the lever for the opening of the circuit and in the opposite direction for closing the circuit, the lever being able to be removably clamped at least in the position for opening the circuit, in order to keep the triggering unit in the open position, without any action of the motor, during the application time of the paint.

In a particularly suitable embodiment, the lever is clamped by a means for locking the pulley in an angular position corresponding to the opening of the circuit.

This locking means can comprise at least one indexing means having a point liable to enter removably into a recess in the pulley corresponding to the open position of the circuit.

Preferably, two indexing means are used diametrically opposite in relation to the pulley spindle and liable of engaging in the pulley, on each side of the spindle, in a diametric groove.

Advantageously, each indexing means is provided, at its end facing the pulley, with a crimped ball that is pushed towards the outside by a spring so that it removably engages in a locking recess in the pulley.

According to another particularly suitable embodiment, the locking of the pulley in the open position determines the switching off of the motor. Conversely, the rotation of the pulley in the direction of closing the circuit can be stopped by an abutment, the stopping of the pulley on this abutment determining the switching off of the motor.

Thanks to these arrangements, the motor only operates during very short periods of time, to command the opening or the closing of the paint supply and, furthermore, the electromechanical system can be so balanced that the torque to be applied by the motor is reduced.

The electrical energy requirements of the system are therefore very small and the motor can be powered by a low cost micro-battery, for example of the type currently sold to the public.

DETAILED DESCRIPTION OF THE PREFERRED EMBODIMENT

Figure 1:
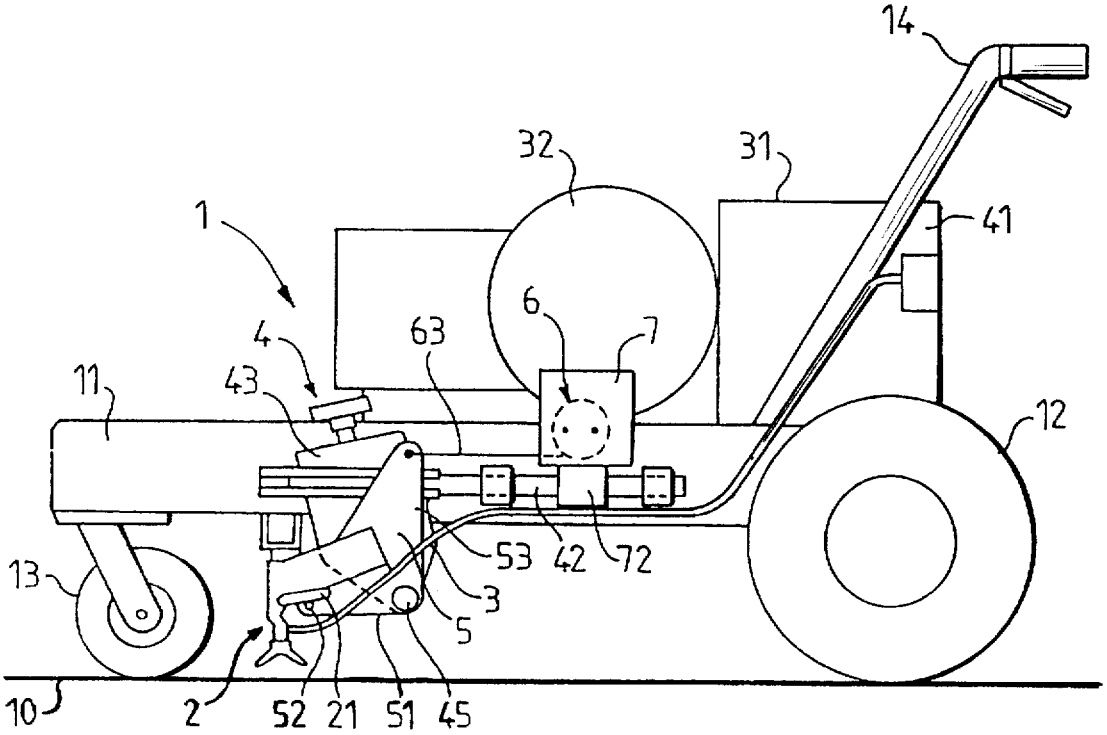
FIG. 1 is a diagrammatic view of the whole of a marking machine provided with a command device according to the invention.

In FIG. 1, by way of mere example, a marking machine 1 has been represented diagrammatically, it comprises a chassis 11 supported by wheels, for example a carrying axle 12 and a steered wheel 13, so that it moves on a roadway 10 under the control of an operator who is walking with the machine directing it by means of steering handgrips 14.

On the chassis 11 of the machine are mounted one or several spray guns 2 connected by a circuit 3 to a supply system comprising a paint reservoir 31 and a pump 32.

The assembly is well known and there is no need to describe it in greater detail.

The opening and the closing of the paint supply circuit 3 is commanded by a triggering unit 21 mounted on the spray gun 2 and actuated by a command device 4 under the control of the operator or an electronic command unit 41, for example a programmable process controller which permits, without any action of the operator, to control the opening and the closing of the supply circuit, for example, in order to produce lines of a specified length.

The command device 4 is supported by a bar 42 fixed onto the chassis 11 and essentially comprises a support piece 43 removably fixed onto the rod 42, for example, by a jaw 44 and carrying a mobile lever 5 hinged on a pivot 45 mounted on the support 43, at the end of one part extending downwards in such a way that it is close to the triggering unit 21 of the spray gun 2.

The mobile lever 5 can comprise a triangular component forming a bell crank which comprises an arm approximately horizontal 51 carrying on its end, an actuating rod 52 for the triggering unit, and a vertical arm 53 for commanding the rotation of the lever 5 around the spindle 45 under the effect of an actuating unit 6 that is also fixed onto the bar 42 rigidly attached to the chassis 11.

Figure 4:
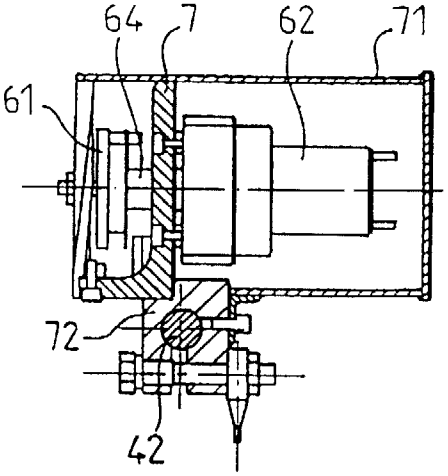
FIG. 4 is a cross sectional view, along the line 4—4 in FIG. 3.
Figure 2:
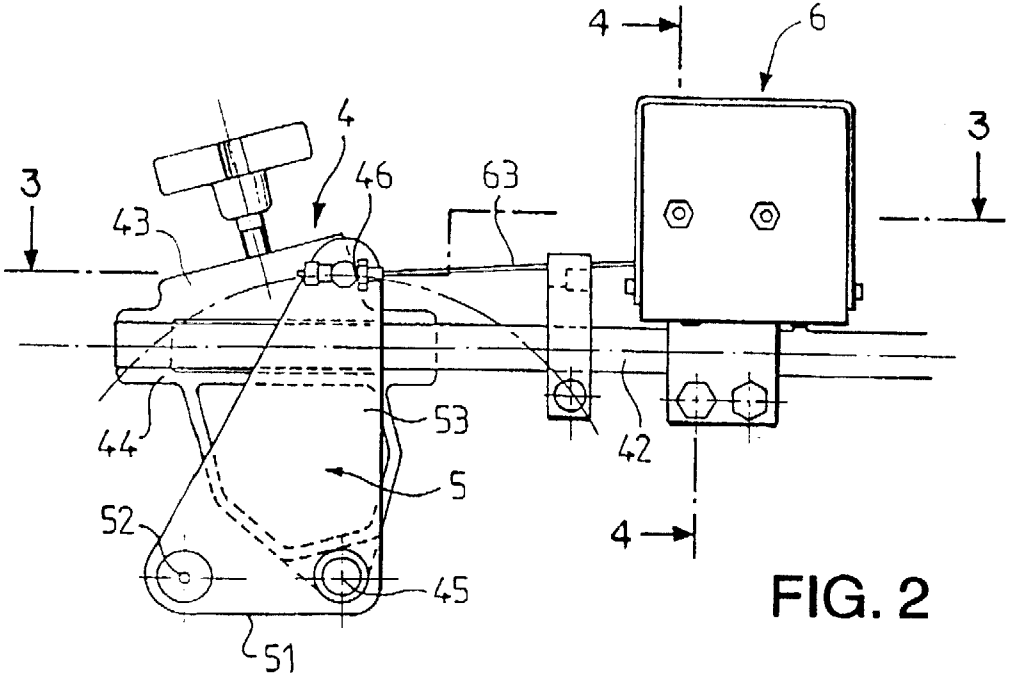
FIG. 2 is a side view, to a larger scale, of the command device.
Figure 3:
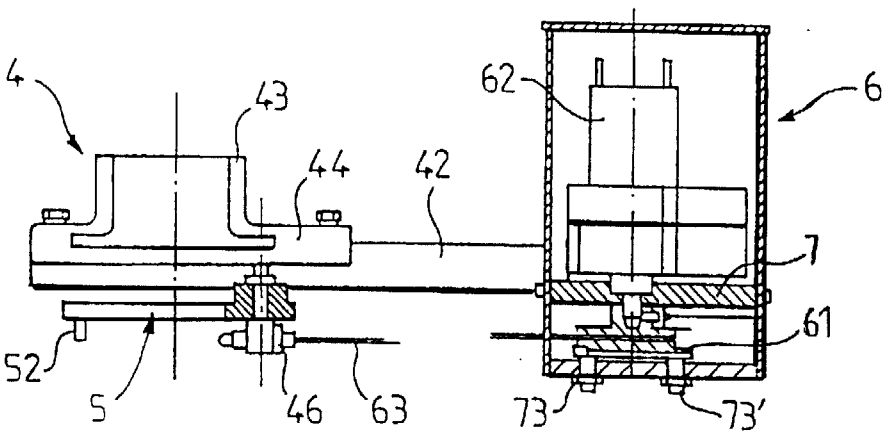
FIG. 3 is a view from above, in partial section along the line 3—3 in FIG. 2.

The actuating unit 6, shown in more detail in FIGS. 3 and 4 essentially comprises a pulley 61 actuated by a motor 62 and onto which winds a cable 63 fixed to the end of the vertical arm 53 of the lever 5.

The pulley 61 is cantilever mounted to the end of a rotating shaft 64 driven by the motor 52 via a built-in reduction gear, the assembly being placed inside a casing 71 and mounted on a support plate 7, that is itself fixed onto the bar 42 by a clamping collar 46 which allows the position of the actuating unit 6 to be adjusted along the bar 42.

It is also possible to adjust the position of the support piece 43 by sliding the jaw 44 along the rod 42 so as to position the rod 52 at the level of the triggering unit 21. Furthermore, the length of the cable 63 can be adjusted by a strainer 46 mounted on a cable tensioner, in a way that ensures the gun is properly opened.

Figure 5:
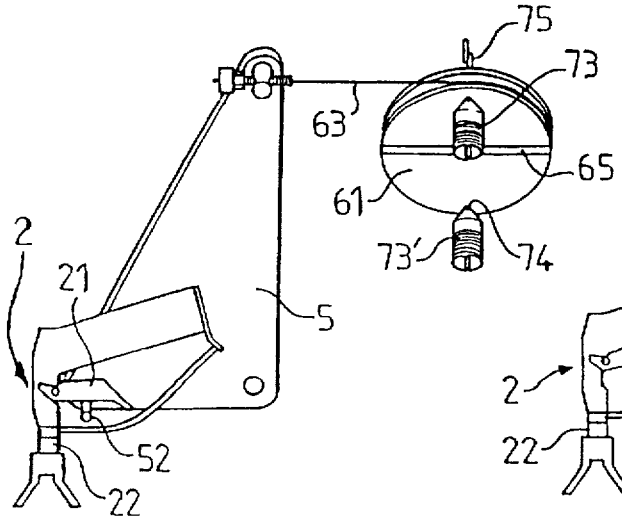
FIGS. 5 and 6 show diagrammatically the command for the triggering unit, respectively for closing and for opening the supply.

The relative positions of the different units can thus be adjusted in such a way that, in the rest position shown in FIG. 5, the rod 52 is in contact with the triggering unit 21 in the form of a trigger, in the position for closing the supply of paint and that the cable 63 is tightened by being wound onto a part of the pulley 61. Said latter is associated with two indexing means 73 each provided with a point onto which a ball 74 is crimped and pushed by a spring which is adjustably compressed by a screw. The ball 74 is thus applied against the facing surface of the pulley 61 in which a diametric groove 65 has been made, approximately parallel to the cable 63, in the rest position represented in FIG. 5.

The motor 62 for driving the pulley 61 is a direct current micro-motor linked to a built-in reducing gear that allows it to supply a high torque with very low power consumption.

As has been indicated, the cable 63 is slightly tensioned in the rest position of the pulley 61 blocked by a limit abutment 75.

When ordered by the command unit 41 or by the operator, the motor 62 is supplied with power so that it commands the rotation of the pulley 61 in the direction corresponding to winding on the cable 63 which causes rotation of the lever 5 and the raising of the rod 52 and of the triggering unit 21 thereby commanding the opening of the paint supply.

Figure 6:
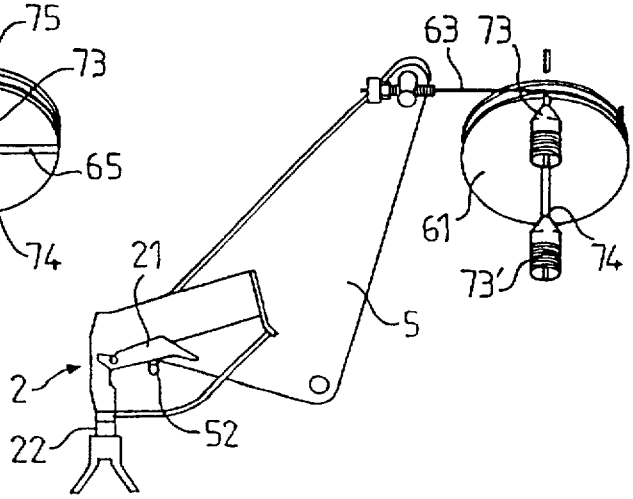

A rotation of a quarter turn of the pulley 61 is sufficient and the groove 65 moves into alignment with the two indexing means 73, the balls 74 engaging in the groove in order to block the rotation of the pulley 61, in the position represented in FIG. 6.

The pulley 61 and, as a consequence, the lever 5 being locked in this way, the power supply for the motor 62 can be switched off, the paint continuing to be supplied via the spray nozzle 22 of the gun 2. The flow rate of paint is defined by the nozzle dimensions and the applied pressure.

In this working position, no electrical energy whatsoever is being consumed and the application of the paint can be carried out by moving the machine 1 forward during the necessary time.

When an order is given by the command unit 41, the motor 62 is supplied with power in the opposite direction.

The lever 5 is brought back to the rest position of FIG. 5, either by a counter-weight or by a resilient device acting on the lever 5 or on the trigger 21 and exerting an effect that is sufficient to assist the rotation of the pulley 61 by disengaging the two indexing means 73. The assembly then returns to the position in FIG. 5, the pulley 61 being stopped by the limit abutment 75 and the paint supply being stopped. The electric power supply to the motor can then be cut off.

The assembly is balanced so that disengagement of the indexing means only requires a small torque.

The electromechanical system that has just been described only requires a small amount of energy to command the rotation of the pulley 61 in one direction or the other and, thanks to the indexing means, avoids any consumption of electrical power during the machine displacement phases, with or without application of paint, the micro-motor only being powered during the very short time necessary to command the opening or the closing of the triggering unit 21.

Because of this, it is possible to associate with the device an autonomous and small energy source, for example, one or two micro-batteries that are rechargeable on the mains, and that can be easily fitted and removed. Such batteries can notably be of the type used in portable camcorders and available to the public.

Of course, the invention is not limited to the details of the embodiment that has just been described by way of mere example, since equivalent means can be used without departing from the scope of the Claims.

In particular, the marking machine has only been described by way of an example, since the command device can be easily adapted to other arrangements for different units, and notably for spray means for paint and triggering means for opening and closing the supply to them.

Furthermore, the invention is especially intended for road marking machines but could find other applications whenever a mobile unit must be commanded for a very short time using a small amount of energy.

We claim:

1. A device for commanding a paint supply circuit in a road marking machine comprising at least one paint application means mounted on a support chassis that can be moved on a roadway along a line to be marked and connected to a paint supply circuit provided with a triggering unit associated with a paint supply circuit wherein it comprises a means for alternately commanding the opening and closing of the supply circuit comprising a mobile lever pivotably mounted around a spindle on the chassis and carrying a means of actuating the triggering unit by pivoting said lever around its spindle respectively in an opening direction and in a direction for closing the circuit, the pivoting of the lever being commanded by a flexible link winding onto a pulley mounted so that it rotates around a spindle on the chassis and liable of being driven in rotation by a motor alternately in a direction for winding on the flexible link that determines the pivoting of the lever for the opening of the circuit and in the opposite direction for closing the circuit, the lever being able to be removably clamped at least in the position for opening the circuit in order to keep the triggering unit in the open position, without any action of the motor, during the application time of the paint.

2. A command device according to claim 1, wherein it comprises a device for locking the pulley in an angular position corresponding to the opening position of the lever.

3. A command device according to claim 2, wherein the pulley locking device comprises at least one indexing means having a point liable to enter removably, into a recess in the pulley corresponding to the open portion of the circuit.

4. A command device according to claim 3, wherein the locking means comprises two indexing means diametrically opposite one another with respect to the spindle of the pulley and liable of engaging on both sides of the spindle, in a diametric groove in the pulley.

5. A command device according to claim 4, wherein each indexing means is provided, at its end facing the pulley with a crimped ball resiliently pushed towards the outside for its removable engagement in the recess in the pulley.

6. A command device according to claim 1, wherein the pulley is linked to a means of commanding the motor that determines that it stops in the angular position of the pulley corresponding to the opening of the circuit.

7. A command device according to claim 1, wherein the rotation of the pulley is stopped, in the direction of closing the circuit, by a limit abutment in an angular position that determines the switching off of the motor.

8. A command device according to claim 1, wherein the motor is supplied with electrical energy by a battery.

9. A machine for marking the road comprising a command device according to claim 1 for the application of paint onto a roadway.

* * * * *